US010910764B2

(12) United States Patent
Gartenmaier

(10) Patent No.: US 10,910,764 B2
(45) Date of Patent: Feb. 2, 2021

(54) COUPLING CONNECTOR COMPRISING A SLIDER PART

(71) Applicant: ODU GmbH & Co. KG, Mühldorf (DE)

(72) Inventor: Daniel Gartenmaier, Erlbach (DE)

(73) Assignee: ODU GmbH & Co. KG, Mühldorf (DE)

( * ) Notice: Subject to any disclaimer, the term of this patent is extended or adjusted under 35 U.S.C. 154(b) by 0 days.

(21) Appl. No.: 16/388,494

(22) Filed: Apr. 18, 2019

(65) Prior Publication Data

US 2020/0153159 A1 May 14, 2020

(30) Foreign Application Priority Data

Nov. 13, 2018 (DE) ..... 20 2018 106 428 U

(51) Int. Cl.

| | |
|---|---|
| ***H01R 13/627*** | (2006.01) |
| ***H01R 13/631*** | (2006.01) |
| ***H01R 13/639*** | (2006.01) |
| ***H01R 43/26*** | (2006.01) |
| *H01R 13/629* | (2006.01) |
| *H01R 13/641* | (2006.01) |

(52) U.S. Cl.

CPC ..... *H01R 13/6271* (2013.01); *H01R 13/631* (2013.01); *H01R 13/639* (2013.01); *H01R 43/26* (2013.01); *H01R 13/62911* (2013.01); *H01R 13/641* (2013.01)

(58) Field of Classification Search

CPC ..... H01R 13/62911; H01R 13/641

See application file for complete search history.

(56) References Cited

U.S. PATENT DOCUMENTS

| | | | |
|---|---|---|---|
| 5,236,373 | A | 8/1993 | Kennedy |
| 6,113,414 | A | 9/2000 | Fukuda |
| 2003/0109155 | A1 | 6/2003 | Yamashita |
| 2004/0002240 | A1 | 1/2004 | Konda |

(Continued)

FOREIGN PATENT DOCUMENTS

| | | | |
|---|---|---|---|
| CN | 103545660 | A | 1/2014 |
| CN | 107785720 | A | 3/2018 |
| CN | 108695654 | A | 10/2018 |

(Continued)

*Primary Examiner* — Tho D Ta

(74) *Attorney, Agent, or Firm* — Laura W. Smalley

(57) ABSTRACT

A connector system with a primary connector and a coupling connector, and a method for connecting a coupling connector and a primary connector. The system provides an insertion aid for mating the connectors. The connector system has a primary connector with a connecting part and a coupling connector with a base unit and a connecting part. The coupling connector has a slider part that moves relative to the base unit to either a preliminary position or a final position. The connecting part of the coupling connector mates with the connecting part of the primary connector. The slider part and the primary connector each have at least one guiding component which both interact to enforce a predefined motion path of the slider part relative to the primary connector when the coupling connector is coupled with the primary connector and the slider part is moved from the preliminary position to the final position.

18 Claims, 13 Drawing Sheets

(56) References Cited

U.S. PATENT DOCUMENTS

| | | | | |
|---|---|---|---|---|
| 2014/0017925 | A1* | 1/2014 | Shiga ..... | H01R 13/62911<br>439/347 |
| 2018/0287296 | A1 | 10/2018 | Furuya et al. | |

FOREIGN PATENT DOCUMENTS

| | | | |
|---|---|---|---|
| DE | 19915187 | A1 | 10/1999 |
| DE | 10252096 | A1 | 6/2003 |
| DE | 10329066 | A1 | 1/2004 |
| DE | 10303382 | A1 | 8/2004 |
| DE | 102014005255 | A1 | 10/2015 |
| DE | 102016215123 | A1 | 2/2018 |
| EP | 3282521 | A2 | 2/2018 |
| GB | 2398679 | A | 8/2004 |
| JP | 2002216895 | A | 8/2002 |
| JP | 2002359030 | A | 12/2002 |
| JP | 2003178840 | A | 6/2003 |
| KR | 20100138072 | A | 12/2010 |

* cited by examiner

COUPLING CONNECTOR COMPRISING A SLIDER PART

CROSS-REFERENCE TO RELATED APPLICATIONS

This application claims priority to German Patent Application DE 20 2018 106 428.2, filed on Nov. 13, 2018, the disclosure of which is incorporated in this application in its entirety.

FIELD OF THE INVENTION

The invention relates to a connector system comprising a primary connector and a coupling connector. The invention further relates to a method for connecting a coupling connector and a primary connector.

BACKGROUND OF THE INVENTION

German patent application DE 102 52 096 A1 describes a lever-type connector, a lever-type connector assembly and a method of assembling a lever-type connector with a mating connector. A first connector has a lever that is rotatable in a rotation direction from an initial position to a connecting position. The lever displays a cam action for urging the first connector into connection with a second connector. The first connector also has a detector that is moveable in a moving direction from a standby position to a detecting position. The moving direction is aligned at an angle to the rotating direction. The lever and the detector are configured so that the lever interferes with the detector and prevents the detector from moving to the detecting position until the lever is in the connecting position.

In German patent application DE 103 03 382 A1, a coupling device with a latching plate is described. The coupling device has a slider therein moveable transversely to a direction of insertion of a connector. The slider is moveable between an open position where the connector is inserted into the coupling device and a closed position where the connector is actuated into electrical contact with the coupling device. The slider has a latching plate movable transversely to a direction of movement of the slider. The latching plate is moveable into latching engagement with the coupling device when the slider is in the closed position to secure the slider in the closed position.

German patent application DE 103 29 066 A1 discloses a connector apparatus. In fitting a moveable-side housing on a stationary-side housing, a front leading end portion of the moveable-side housing is brought into contact with a front base portion of the stationary-side housing. At this time, it is unnecessary to accurately place the movable-side housing in position. When the movable-side housing is moved toward a matching position, guides guide the movable-side housing to the matching position reliably. Consequently, the cam followers fit into entrances of cam grooves. Thereafter, a slide lever is moved to bring electrodes of one housing into connection with electrodes of the other housing. It is not difficult to properly position the movable-side housing with respect to the stationary-side housing. Therefore, even in a situation in which it is difficult to visually check the position of the movable-side housing, an operation of fitting the movable-side housing on the stationary-side housing can be performed easily and reliably.

In German patent application DE 199 15 187 A1, a plug connection locking mechanism is described. A connector lock structure includes a female connector housing having a connector fitting chamber, a male connector housing having an engagement projection, and a slide member mounted on the female connector housing for sliding movement in a direction perpendicular to a connector fitting direction. An elastic lock arm is formed on the female connector housing, and a flexure reception portion for receiving the lock arm is provided at the slide member. The engagement projection raises the lock arm into the flexure reception portion, and an inner side surface of the flexure reception portion abuts against a side surface of the lock arm. That portion of a bottom surface of the slide member, disposed adjacent to the flexure reception portion, abuts against that surface of the lock arm facing in a direction of flexing of the lock arm. A slide protuberance is formed on the male connector housing, and a guide groove is formed in the female connector housing, and a provisionally-retaining arm is formed on the slide member. The provisionally-retaining arm is engaged in the guide groove, and is pressed by the slide protuberance, thereby canceling a provisional retainment.

German patent application DE 10 2014 005 255 A1 discloses a horizontally lockable connector. The connector comprises a plug, a plug receptacle and a locking mechanism by which the plug and the plug receptacle are lockable in a state in which the plug and the plug receptacle are mechanically engaged and electrically connected to each other. The locking mechanism has a sliding adapter and a guide frame at the plug receiving side, which are displaceable relative to each other along a main displacement direction between a release position at which the plug and the plug receptacle can be disconnected and preliminarily connected, and a locking position at which a disconnection between the plug and plug receptacle is prevented. The locking mechanism further comprises a secondary element which interacts with the sliding adapter and the guide frame in a way that a displacement of the locking mechanism from the release position to the locking position is blocked in case the plug is disconnected.

In German patent application DE 10 2016 215 123 A1, a plug connector system is described. According to one aspect, a locking element is provided on the socket housing of the system such that a superior degree of flexibility may be achieved upon mounting and connecting the plug connector system, in particular, in critical applications, such as usage in combination with battery modules. In a further aspect, a socket housing and/or a pin housing of the plug connector system are provided with a resilient prefixing element in order to achieve a preliminary fixation corresponding to a degree of elasticity, thereby allowing tolerances to be taken into consideration. In a further aspect, the plug connector system comprises an assurance having a double function, thereby accomplishing the secondary assurance of contacts and the locking of the housing components on the basis of one single component.

U.S. Pat. No. 5,236,373 A describes a connector assembly for assuring proper engagement of mated electrical connectors. The assembly includes a pair of connectors which are configured for crating electrical contact between terminals housed therein. A position assurance member is retainingly engaged with one of the connectors in a preassembled position. If the connectors are properly engaged, the connection position assurance member is capable of being moved from its preassembled position to a second or home position. Upon improper engagement of the connectors, movement of the position assurance member from its preassembled position to its home position is prohibited thereby indicating that improper engagement between the connectors exists.

OBJECT OF THE INVENTION

It is an object of the present invention to provide an improved connector system that provides an insertion aid for mating the connectors. A further object of the invention is to provide a connector system that requires less installation space. Moreover, the invention seeks to provide a connector system that is suitable for connecting power connectors.

Solution According to the Invention

According to the invention, the problem is solved by a connector system with the features of claim 1. The connector system comprises a primary connector comprising a first connecting part and a coupling connector comprising a base unit with a second connecting part, the coupling connector further comprising a slider part configured for moving relative to the base unit in a sliding direction, wherein the slider part can be moved to a preliminary position and to a final position relative to the base unit. The second connecting part of the coupling connector is configured to mate with the first connecting part of the primary connector in a mating direction. The slider part comprises at least one first guiding component and the primary connector comprises at least one second guiding component, wherein the at least one first guiding component and the at least one second guiding component are configured for interacting to enforce a predefined motion path of the slider part relative to the primary connector when the coupling connector is coupled with the primary connector and the slider part is moved from the preliminary position to the final position. The slider part's motion along the predefined motion path comprises pressing the second connecting part against the first connecting part such that the first connecting part and the second connecting part are mated in the mating direction.

The connector system comprises a primary connector with a first connecting part and a coupling connector with a second connecting part. The respective connecting parts of the two connectors are configured to mate. For example, the connecting parts may comprise one or more contact elements, for example contact pins or sockets, for establishing one or more electrical connections when the first and the second connecting part are mated. For establishing these electrical connections between the connecting parts, a predefined insertion force may for example be required.

According to the present invention, the coupling connector comprises a slider part which may act as an insertion aid when mating the first connecting part and the second connecting part. The slider part's motion is controlled by two forced guidances. Relative to the base unit of the coupling connector, the slider part performs a sliding movement along a predefined sliding direction. For example, the coupling connector may comprise a sliding mechanism that allows for sliding the slider part relative to the base unit. In addition to that, the motion of the slider part relative to the primary connector is determined by guiding components. The slider part's first guiding components interact with the primary connector's second guiding components in a way that a predefined motion path of the slider part relative to the primary connector is enforced. The slider part's motion along the predefined motion path comprises pressing the second connecting part against the first connecting part, in order to mate the first and the second connecting part.

In this regard, the slider part acts as an insertion aid configured for converting the force required for moving the slider part from a preliminary position to a final position into a force that presses the second connecting part against the first connecting part, thereby mating the two connecting parts. By means of the slider part, even large insertion forces can for example be generated. The present invention is not limited to large insertion forces and can also be used for producing small insertion forces. The connector system of the present invention does not require a large amount of installation space. It can be used even in small and cramped spaces.

The problem according to the invention is further solved by a method for connecting a coupling connector and a primary connector according to claim 14. The primary connector comprises a first connecting part. The coupling connector comprises a base unit with a second connecting part and further comprises a slider part configured for moving relative to the base unit in a sliding direction, wherein the slider part can be moved to a preliminary position and to a final position relative to the base unit. The slider part comprises at least one first guiding component and the primary connector comprises at least one second guiding component. The method comprises coupling the coupling connector with the primary connector. The method further comprises moving the slider part from the preliminary position to the final position, wherein the at least one first guiding component and the at least one second guiding component interact to enforce a predefined motion path of the slider part relative to the primary connector. The slider part's motion along the predefined motion path comprises pressing the second connecting part against the first connecting part such that the first connecting part and the second connecting part are mated in the mating direction.

In addition to that, the problem according to the invention is solved by a connector system according to claim 15. The connector system comprises a primary connector comprising a first connecting part and a coupling connector comprising a base unit with a second connecting part, the coupling connector further comprising a slider part configured for moving relative to the base unit in a sliding direction, wherein the slider part can be moved to a preliminary position and to a final position relative to the base unit. The second connecting part of the coupling connector is configured to mate with the first connecting part of the primary connector in a mating direction when the slider part is moved from the preliminary position to the final position. The coupling connector comprises a latching mechanism, wherein when the slider part reaches the final position, at least one latching element of the base unit engages with at least one counter-latching element of the slider part.

The connector system comprises a slider part that acts as an insertion aid. When the slider part is moved from the preliminary position to the final position, the first connecting part is mated with the second connecting part. In the slider part's final position, the slider part is latched by means of a latching mechanism. Thus, the connection of the primary connector and the coupling connector is secured and cannot detach.

The problem according to the invention is also solved by a connector system according to claim 16. The connector system comprises a primary connector comprising a first connecting part and a coupling connector comprising a base unit with a second connecting part, the coupling connector further comprising a slider part configured for moving relative to the base unit in a sliding direction, wherein the slider part can be moved to a preliminary position and to a final position relative to the base unit. The second connecting part of the coupling connector is configured to mate with the first connecting part of the primary connector in a mating direction when the slider part is moved from the preliminary position to the final position. The coupling connector comprises a locking member, wherein the locking member is configured for being moved either to a non-locking position or to a locking position when the slider part is in its final position, and wherein the slider part is locked when the locking member is in the locking position.

The above-described connector system further comprises a locking member. The locking member is configured for being moved from a non-locking position to a locking position in case the slider part is in its final position. In the locking member's locking position, the slider part is locked. Thus, the connection between the primary connector and the coupling connector is fixed.

Moreover, the problem according to the invention is solved by a connector system according to claim 17. The connector system comprises a primary connector comprising a first connecting part and a coupling connector comprising a base unit with a second connecting part, the coupling connector further comprising a slider part configured for moving relative to the base unit in a sliding direction, wherein the slider part can be moved to a preliminary position and to a final position relative to the base unit. The second connecting part of the coupling connector is configured for being mated with the first connecting part of the primary connector in a mating direction when the slider part is moved from the preliminary position to the final position. A plug-in connector comprises a locking mechanism configured for hindering the slider part from moving from the preliminary position to the final position as long as the coupling connector is not coupled with the primary connector, wherein the coupling connector and the primary connector are shaped and configured such that the locking mechanism is unlocked when the coupling connector and the primary connector are coupled.

In other words, the connector system comprises a further locking mechanism that locks the slider part in its preliminary position as long as the coupling connector is not coupled with the primary connector. The further locking mechanism ensures that the slider part is in its preliminary position relative to the base unit when the coupling connector is mated with the primary connector.

The problem according to the invention is further solved by a connector system according to claim 18. The connector system comprises a primary connector comprising a first connecting part and a coupling connector comprising a base unit with a second connecting part, the coupling connector further comprising a slider part configured for moving relative to the base unit in a sliding direction, wherein the slider part can be moved to a preliminary position and to a final position relative to the base unit. The second connecting part of the coupling connector is configured to mate with the first connecting part of the primary connector in a mating direction when the slider part is moved from the preliminary position to the final position. At least one supporting element is provided at a portion of the slider part that faces the primary connector, wherein the at least one supporting element is configured for engaging with at least one corresponding counter piece of the primary connector when the slider part is moved to its final position.

In the above-described connector system, the stability of the coupling connector relative to the primary connector is improved by providing at least one supporting element configured for supporting the coupling connector at a plurality of supporting points. Thus, tilting of the coupling connector relative to the primary connector is prevented.

PREFERRED EMBODIMENTS OF THE INVENTION

Preferred features of the invention which may be applied alone or in combination are discussed below and in the dependent claims.

Preferably, the predefined motion path is defined such that the second connecting part is pressed against the first connecting part by the slider part such that the first connecting part and the second connecting part are mated in the mating direction. For example, when moving along the predefined motion path, the slider part may move towards the primary connector. Because the slider part is coupled with the base unit by means of a sliding mechanism, the base unit together with the second connecting part is also pressed in the direction towards the primary connector's first connecting part. Thus, due to the movement of the slider part, the second connecting part is mated with the first connecting part.

Preferably, when the coupling connector is coupled with the primary connector, with the slider part being in its preliminary position, the first connecting part is located opposite to the second connecting part. Preferably, the connecting part is aligned with the first connecting part when the coupling connector is coupled with the primary connector. For mating the first and the second connecting part, it is necessary to press the second connecting part against the first connecting part with a sufficient force, for example with an insertion force of sufficient magnitude. The required force is executed by the slider part.

Preferably, the at least one first guiding component and the at least one second guiding component are configured for engaging when the coupling connector is coupled with the primary connector. For example, when the coupling connector is placed on the primary connector, the at least one first guiding component of the slider part engages with the at least one second guiding component of the primary connector. Thus, the interaction between the guiding components is established when the coupling connector is coupled with the primary connector.

Preferably, the at least one first guiding component and the at least one second guiding component are configured for fastening the coupling connector relative to the primary connector when the slider part is moved from its preliminary position to its final position. The interaction between the first and the second guiding components enforces a motion path of the slider part when the slider part is moved from the preliminary position to the final position. In the course of this motion, the base unit with the second connecting part is pressed against the first connecting part. Additionally, the connection between the coupling connector and the primary connector may for example be fastened by the slider part. Preferably, the at least one first guiding component and the at least one second guiding component are configured for fixing a connection between the coupling connector and the primary connector when the slider part is moved from its preliminary position to its final position.

Preferably, the first connecting part comprises at least one first contact element, wherein the second connecting part comprises at least one second contact element, and wherein, when the first connecting part is mated with the second connecting part, electrical connections are established between the at least one first contact element and the at least one second contact element. Thus, between the primary connector and the coupling connector, one or more electrical connections can be established when the first connecting part is mated with the second connecting part. Preferably, the electrical connections are suited for conducting large currents.

According to a preferred embodiment, the at least one first contact element is implemented as at least one contact pin and the at least one second contact element is implemented as at least one contact socket. According to an alternatively preferred embodiment, the at least one first contact element is implemented as at least one contact socket and the at least one second contact element is implemented as at least one contact pin. Preferably, for each of the first contact elements and the second contact elements, a touch protection is provided. Thus, it is prevented that a user touches live parts of the first contact elements and the second contact elements.

Preferably, the at least one contact pin and the at least one contact socket are implemented such that an insertion force of more than 75 N is required for mating the first connecting part and the second connecting part. Due to the large insertion force, stable and reliable electrical connections can be established. Even if the primary connector is mounted overhead, the coupling connector will be tightly held because of the large insertion force. An insertion force of sufficient magnitude can be produced by pushing the slider part from its preliminary position to the final position. Preferably, for moving the slider part from its preliminary position to the final position, a force of less than 75 N is sufficient.

Preferably, the slider part comprises at least one first guiding component and the primary connector comprises at least one second guiding component, wherein the at least one first guiding component and the at least one second guiding component are configured for interacting to enforce a predefined motion path of the slider part relative to the primary connector in case the coupling connector is coupled with the primary connector and the slider part is moved from the preliminary position to the final position. Further preferably, the slider part's motion along the predefined motion path comprises pressing the second connecting part against the first connecting part such that the first connecting part and the second connecting part are mated in the mating direction. During the mating process, the slider part moves along the predefined motion path and presses the base unit together with the second connecting part against the first connecting part. Thus, the slider part is for example capable of mating connectors requiring a large insertion force, for example in the field of power connectors. The connector system may as well be used in the field of low insertion force connectors, though.

Preferably, the slider part comprises at least one first guiding component per lateral side on each of the two lateral sides of the slider part, wherein the primary connector comprises second guiding components that correspond to the first guiding components, wherein the at least one first guiding component per lateral side of the slider part is configured for engaging with the corresponding second guiding components of the primary connector. By providing guiding components on each of the two lateral sides of the slider part, it is made sure that the slider part is symmetrically mated with the primary connector.

Further preferably, the slider part comprises at least two first guiding components per lateral side on each of the two lateral sides of the slider part, wherein the at least two first guiding components per lateral side are spaced from one another in the sliding direction, wherein the primary connector comprises second guiding components that correspond to the first guiding components, wherein the at least two first guiding components per lateral side of the slider part are configured for engaging with the corresponding second guiding components of the primary connector. By providing at least two first guiding components per lateral side on each of the two lateral sides of the slider part, it is made sure that at least four first guiding components of the slider part interact with at least four corresponding second guiding components of the primary connector during the mating process. Accordingly, a stable support of the coupling connector during the mating process is provided, with the coupling connector resting on at least four points of support. For example, the slider part and the primary connector may comprise at least two slotted guide systems per lateral side of the slider part when viewed in the sliding direction.

Preferably, the at least two first guiding components per lateral side of the slider part and the corresponding second guiding components are configured for enforcing an orientation of the coupling connector relative to the primary connector during the process of connecting the coupling connector and the primary connector. Preferably, the at least two first guiding components per lateral side of the slider part and the corresponding second guiding components are configured for stabilising the orientation of the coupling connector with respect to the primary connector. By supporting the coupling connector by at least four points of support, the required orientation of the coupling connector can be obtained.

Preferably, the at least two first guiding components per lateral side of the slider part and the corresponding second guiding components are configured for preventing tilting of the coupling connector with respect to the primary connector during the process of connecting the coupling connector and the primary connector. Tilting of the coupling connector relative to the primary connector should be avoided, because it may give raise to leverage forces and corresponding safety hazards.

Preferably, the at least one first guiding component is implemented as at least one protrusion, wherein the at least one second guiding component is implemented as at least one groove or slot, and wherein the at least one protrusion is configured for interacting with the at least one groove or slot. In this example, when the coupling connector is placed on the primary connector, the at least one protrusion of the primary connector engages with the at least one groove or slot of the slider part. When the slider part is pushed to its final position, the at least one protrusion moves along the at least one groove or slot and enforces a predefined motion path.

According to an alternatively preferred embodiment, the at least one first guiding component is implemented as at least one groove or slot, wherein the at least one second guiding component is implemented as at least one protrusion, and wherein the at least one protrusion is configured for interacting with the at least one groove or slot. In this example, the at least one groove or slot is located on the part of the primary connector, whereas the at least one protrusion is located on the slider part.

Preferably, the at least one groove or slot is shaped and configured for enforcing the predetermined motion path of the slider part relative to the primary connector.

Preferably, the at least one groove or slot is curved. Alternatively, the at least one groove or slot may for example be straight.

In a preferred embodiment, at least a portion of the at least one groove or slot is inclined relative to the sliding direction. Preferably, at least a portion of the at least one groove or slot is inclined towards the primary connector. Hence, when moving along the inclined path defined by the at least one groove or slot, the slider part gets gradually closer to the primary connector and presses the second connecting part against the first connecting part. Preferably, at least a portion of the at least one groove or slot is inclined relative to a plane perpendicular to the mating direction. Preferably, at least a portion of the at least one groove or slot is inclined at an angle of more than 10° relative to the sliding direction. Further preferably, at least a portion of the at least one groove or slot is inclined at an angle of less than 20° relative to the sliding direction.

Preferably, the coupling connector is configured such that the slider part moves relative to the base unit in the sliding direction. Further preferably, the coupling connector comprises a sliding mechanism configured such that the slider part moves relative to the base unit in the sliding direction. Accordingly, movement of the slider part relative to the base unit is restricted to the sliding direction. Due to the presence of the sliding mechanism, when the slider part moves closer to the primary connector, it also pushes the base unit and the second connecting part towards the primary connector.

Preferably, the slider part at least partially encloses the base unit. For example, the slider part may at least partially cover the base unit. Further preferably, the slider part at least partially encloses the outer surface of the base unit.

According to a preferred embodiment, at least a part of the outer surface of the slider part is configured as a gripping surface. Preferably, the gripping surface is configured for being grasped by a user in order to move the slider part in the sliding direction. The user may for example grip the slider part's gripping surface and move the slider part from the preliminary position to the final position. Thus, the slider part itself may serve as an actuation element configured for producing the force required for mating the first and the second connecting part. Preferably, the connector system does not comprise an additional lever.

Preferably, the slider part is configured for sliding along the base unit in the sliding direction. According to a further preferred embodiment, the slider part is configured for sliding along the outer surface of the base unit in the sliding direction.

Preferably, the sliding mechanism comprises guide rails that extend in the sliding direction.

According to a further preferred embodiment, the sliding mechanism comprises at least one rib extending in the sliding direction on the outer surface of the base unit and at least one groove extending in the sliding direction on the inner surface of the slider part, with the at least one rib being configured for engaging with the at least one groove. The relative movement of the rib inside the grooves allows for a sliding movement of the slider part relative to the base unit.

According to an alternatively preferred embodiment, the sliding mechanism comprises at least one groove extending in the sliding direction on the outer surface of the base unit and at least one rib extending in the sliding direction on the inner surface of the slider part, with the at least one rib being configured for engaging with the at least one groove.

Preferably, the slider part is implemented as a sleeve that at least partially encloses the base unit. Preferably, the slider part is implemented as a sleeve configured for sliding along the base unit in the sliding direction.

Preferably, the coupling connector comprises at least one cable port configured for introducing at least one cable to the power connector. For example, the coupling connector may comprise two cable ports configured for introducing two cables to the power connector. Further preferably, the coupling connector is a power connector, with power cables being introduced to the coupling connector via the at least one cable port.

Preferably, the sliding direction of the slider part is oriented at an angle of at most 30° relative to the cable direction of the at least one cable entering the coupling connector, further preferably at an angle of at most 25°, further preferably at an angle of at most 20°, further preferably at an angle of at most 15°, further preferably at an angle of 10° relative to the cable direction of the at least one cable entering the coupling connector. The cable direction is the direction of the at least one cable at the point where the at least one cable enters the coupling connector, for example at at least one respective cable port. In case of two or more cables, the cable direction is the averaged direction of the two or more cables at the respective points where they enter the coupling connector. In a preferred embodiment, the sliding direction of the slider part is approximately equal to the cable direction. The slider part is moved in the direction along the cable or at an angle of at most 30° relative to the cable direction. The at least one cable may for example pass underneath the slider part. Thus, installation space can be minimised.

Relative to the axial direction of the at least one cable port, the sliding direction of the slider part is preferably oriented at an angle of at most 30°, further preferably at an angle of at most 25°, further preferably at an angle of at most 20°, further preferably at an angle of at most 15°, further preferably at an angle of 10° relative to the axial direction of the at least one cable port. Further preferably, the sliding direction of the slider part is approximately equal to the axial direction of the at least one cable port.

In a preferred embodiment, the slider part at least partially encloses the at least one cable port. Further preferably, the slider part at least partially encloses the at least one cable port and parts of the at least one cable. Preferably, the slider part surrounds the at least one cable port. Preferably, a portion of the slider part that is oriented towards the at least one cable encloses the at least one cable port. A portion of the slider part that is oriented towards the at least one cable may for example surround the at least one cable port.

According to a preferred embodiment, a portion of the slider part that is oriented towards the at least one cable is configured for sliding along the at least one cable port.

Preferably, the slider part is implemented as a sleeve that at least partially encloses the base unit and the at least one cable port. For example, at least a portion of the slider part that is oriented towards the at least one cable may be implemented as a sleeve that at least partially encloses the at least one cable port.

Preferably, the sliding direction of the slider part relative to the base unit is oriented at an angle of more than 70° relative to the mating direction of the first and the second connecting part, further preferably at an angle of more than 80° relative to the mating direction. Further preferably, the sliding direction of the slider part is oriented at an angle of less than 110° relative to the mating direction, further preferably at an angle of less than 100° relative to the mating direction. Further preferably, the sliding direction of the slider part relative to the base unit is approximately perpendicular to the mating direction of the first and the second connecting part. Hence, the slider part is moved in a direction approximately perpendicular to the mating direction, with the movement of the slider part being transformed into an insertion force required for mating the first and the second connecting part.

Preferably, the coupling connector comprises a latching mechanism, wherein when the slider part reaches the final position, at least one latching element of the base unit engages with at least one counter-latching element of the slider part. By means of the latching mechanism, the slider part is fixed at its final position. Thus, a detachment of the coupling connector is prevented.

Preferably, the base unit comprises at least one latching element, wherein the slider part comprises at least one counter-latching element, wherein the at least one latching element is configured for latching the at least one counter-latching element when the slider part reaches its final position relative to the base unit. For example, the at least one latching element may be resiliently mounted on the base unit.

Further preferably, the at least one counter-latching element may for example be implemented as one of the following: an opening, a cut-out, a recess, an indentation.

According to a preferred embodiment, the slider part or the base unit comprises a release button configured for releasing, upon actuation, an engagement between the at least one latching element and the at least one counter-latching element. As long as the release button is not actuated, the engagement between the at least one latching element and the at least one counter-latching element cannot be released and the slider part remains fixed in its final position.

Preferably, as soon as an engagement between the at least one latching element and the at least one counter-latching element is released, the slider part can be moved from the final position to the preliminary position. Thus, the connection between the coupling connector and the primary connector can be disconnected upon actuating the release button.

Preferably, the coupling connector comprises a locking member, wherein the locking member is configured for being moved either to a non-locking position or to a locking position in case the slider part is in its final position, wherein in the locking member's locking position, the slider part is locked. By means of the locking member, also referred to as a connector position assurance or CPA, the connection between the coupling connector and the primary connector can be further secured. Before disconnecting the two connectors, the locking member has to be moved to the non-locking position.

Preferably, in the locking member's non-locking position, the slider part is not locked by the locking member. Preferably, the locking member is configured for being moved in a direction at an angle of more than 70° relative to the sliding direction, further preferably at an angle of more than 80° relative to the sliding direction. Further preferably, the locking member is configured for being moved in a direction at an angle of less than 110° relative to the sliding direction, further preferably at an angle of less than 100° relative to the sliding direction. Preferably, the locking member is configured for being moved in a direction approximately perpendicular to the sliding direction. Further preferably, the locking member is configured for being moved in a direction at an angle of more than 70° relative to the mating direction of the first and the second connecting part. Further preferably, the locking member is configured for being moved in a direction at an angle of less than 110° relative to the mating direction. Accordingly, the locking member is moved in a transverse direction of the coupling connector. This arrangement of the locking member allows to effectively lock the slider part. Preferably, in the locking member's locking position, the slider part is positively locked.

Preferably, the locking member is configured for blocking at least one of the base unit's latching elements in the locking member's locking position. According to another preferred embodiment, the locking member is configured for blocking the release button in the locking member's locking position. Preferably, a part of the locking member is configured for reaching under at least one of the base unit's latching elements in the locking member's locking position such that at least one of the latching elements is blocked. Preferably, a part of the locking member is configured for being inserted into an interspace between at least one of the latching elements and the remaining part of the base unit in the locking member's locking position such that said at least one of the latching elements is blocked and cannot be disengaged from the at least one counter-latching element. This is an additional measure for securing the connection between the coupling connector and the primary connector.

Preferably, in the locking member's locking position, at least one of the base unit's latching elements is blocked and the engagement between the at least one latching element and the at least one counter-latching element cannot be released. Further preferably, in the locking member's non-locking position, none of the base unit's latching elements is blocked and the engagement between the at least one latching element and the at least one counter-latching element can be released by actuating the release button.

According to a preferred embodiment, the locking member comprises a pin and the slider part comprises an L-shaped groove or slot, with the locking member's pin being configured for engaging with the L-shaped groove or slot. Further preferably, in the locking member's locking position, the locking member's pin is positively locked in an end portion of the L-shaped groove or slot.

In a preferred embodiment, the coupling connector comprises a data code, the data code being disposed such that in case the locking member is in its locking position, the data code is exposed, and in case the locking member is in its non-locking position, the data code is not exposed. The data code may for example indicate that the process of connecting the coupling connector and the primary connector is finished and that the coupling connector is fully mated with the primary connector. In particular, the exposed data code indicates that the locking member has been moved to its locking position. The data code may for example be captured and analysed by means of an image processing system, in order to detect that the connection between the coupling connector and the primary connector has been properly established. Preferably, the data code is a QR code or a data matrix code.

Preferably, the connector system comprises a further locking mechanism configured for hindering the slider part from moving from the preliminary position to the final position as long as the coupling connector is not coupled with the primary connector. The further locking mechanism ensures that the slider part is in its preliminary position relative to the base unit until the coupling connector is coupled with the primary connector.

Further preferably, the coupling connector and the primary connector are shaped and configured such that the locking mechanism is unlocked when the coupling connector and the primary connector are coupled. At the instant when the coupling connector is coupled with the primary connector, the lock is released and the slider part can be moved relative to the base unit.

Preferably, the slider part comprises at least one first locking element and the base unit comprises at least one second locking element, wherein the at least one first locking element is configured for engaging with the at least one second locking element and for locking the slider part in the preliminary position as long as the coupling connector is not coupled with the primary connector. As long as the locking elements are engaged, the slider part is locked in its preliminary position.

Further preferably, the primary connector comprises at least one actuation element disposed at the portion of the primary connector that faces the coupling connector when the coupling connector and the primary connector are mated. Preferably, in case the coupling connector is not coupled with the primary connector, the actuation element of the primary connector does not interact with the locking elements of the coupling connector and the slider part is locked in the preliminary position. Further preferably, in case the coupling connector is coupled with the primary connector, the at least one actuation element interacts with at least one of the locking elements of the coupling connector, thereby unlocking the slider part relative to the base unit. Hence, the actuating element is configured for releasing the lock of the slider part as soon as the coupling connector and the primary connector are mated.

According to a preferred embodiment, at a portion of the slider part that faces the primary connector, at least one supporting element is provided, the at least one supporting element being configured for engaging with at least one corresponding counter piece of the primary connector when the slider part is moved to its final position. The at least one supporting element and the at least one corresponding counter piece provide for an additional stabilisation of the coupling connector relative to the primary connector.

Preferably, the at least one supporting element provides at least one additional point of support for stabilising the coupling connector relative to the primary connector.

Further preferably, at least one of the supporting elements has an undercut configured for engaging with the corresponding counter piece. The undercut allows for an engagement between the respective supporting element and its counter piece.

Preferably, the primary connector is configured to be mounted on an electric component. For example, the primary connector may be mounted on a traction battery.

In a preferred embodiment, the connector system is configured for establishing an electrical connection between a traction battery and an electric component of a vehicle. For example, the connector system may be configured for transmitting power from the traction battery to an electric component of the vehicle. Preferably, the connector system is configured for establishing an electrical connection between a traction battery and an inverter of the vehicle. For example, the primary connector may be mounted on a traction battery of a vehicle. In this respect, the connector system is configured for establishing an electrical connection with the traction battery.

BRIEF DESCRIPTION OF THE DRAWINGS

In the following, further preferred embodiments of invention are illustrated by means of examples. The invention is not limited to these examples, however.

The drawings schematically show.

DETAILED DESCRIPTION OF EMBODIMENTS OF THE INVENTION

Figure 1:
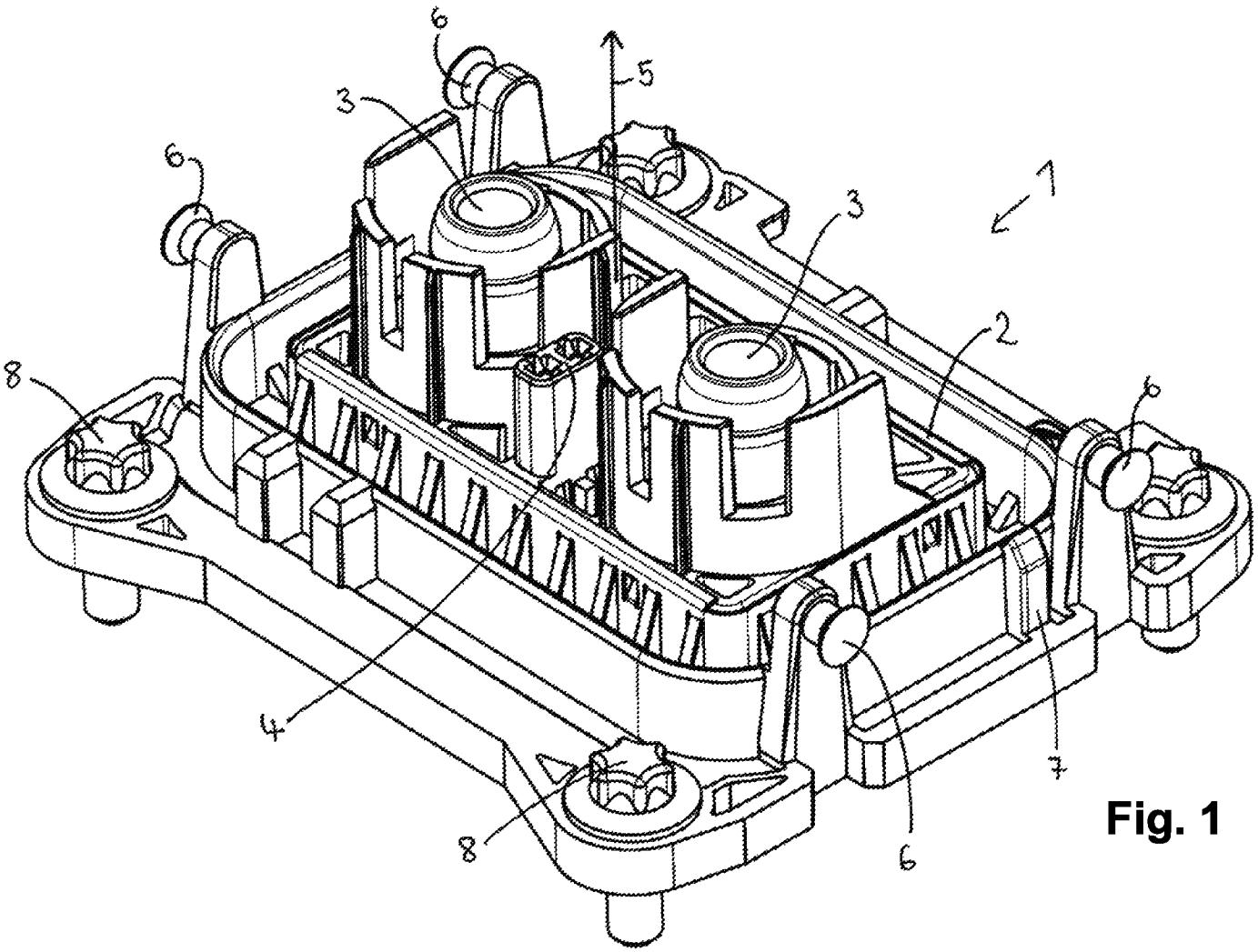
FIG. 1 shows a perspective view of a primary connector.

In the following description of preferred embodiments of the present invention, identical reference numerals denote identical or comparable components.

The connector system comprises a primary connector and a coupling connector that can be mated with the primary connector. In FIG. 1, a perspective view of a primary connector 1 is shown. The primary connector 1 comprises a first connecting part 2 with two contact pins 3 and two signal contact elements 4, wherein the first connecting part 2 is configured for being mated with a second connecting part in a mating direction 5. The primary connector 1 further comprises a plurality of pins 6 disposed at the lateral sides of the primary connector 1, with the pins 6 extending in an outward direction. The pins 6 are part of guide mechanisms that define the relative motion between the coupling connector and the primary connector 1 when the connectors are mated. Furthermore, a chamfered pin element 7 is provided at the lateral side of the primary connector 1. The primary connector 1 can be attached to a respective component with a plurality of screws 8. In particular, the primary connector 1 may be mounted on a traction battery of a vehicle. The connector system may be configured for establishing an electric connection between the traction battery and an electric component of the vehicle.

Figure 2:
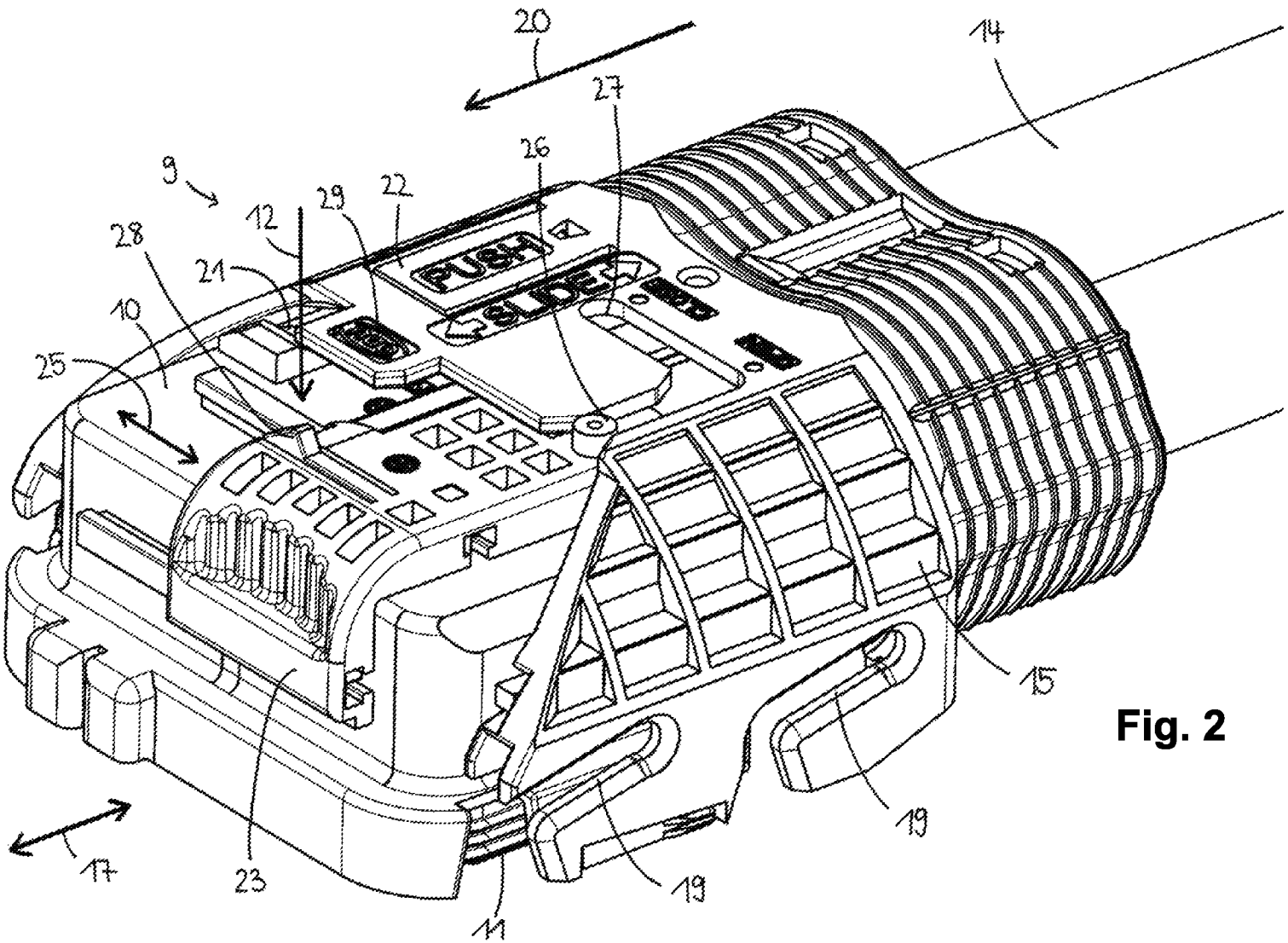
FIG. 2 shows a perspective view of a coupling connector.
Figure 3:
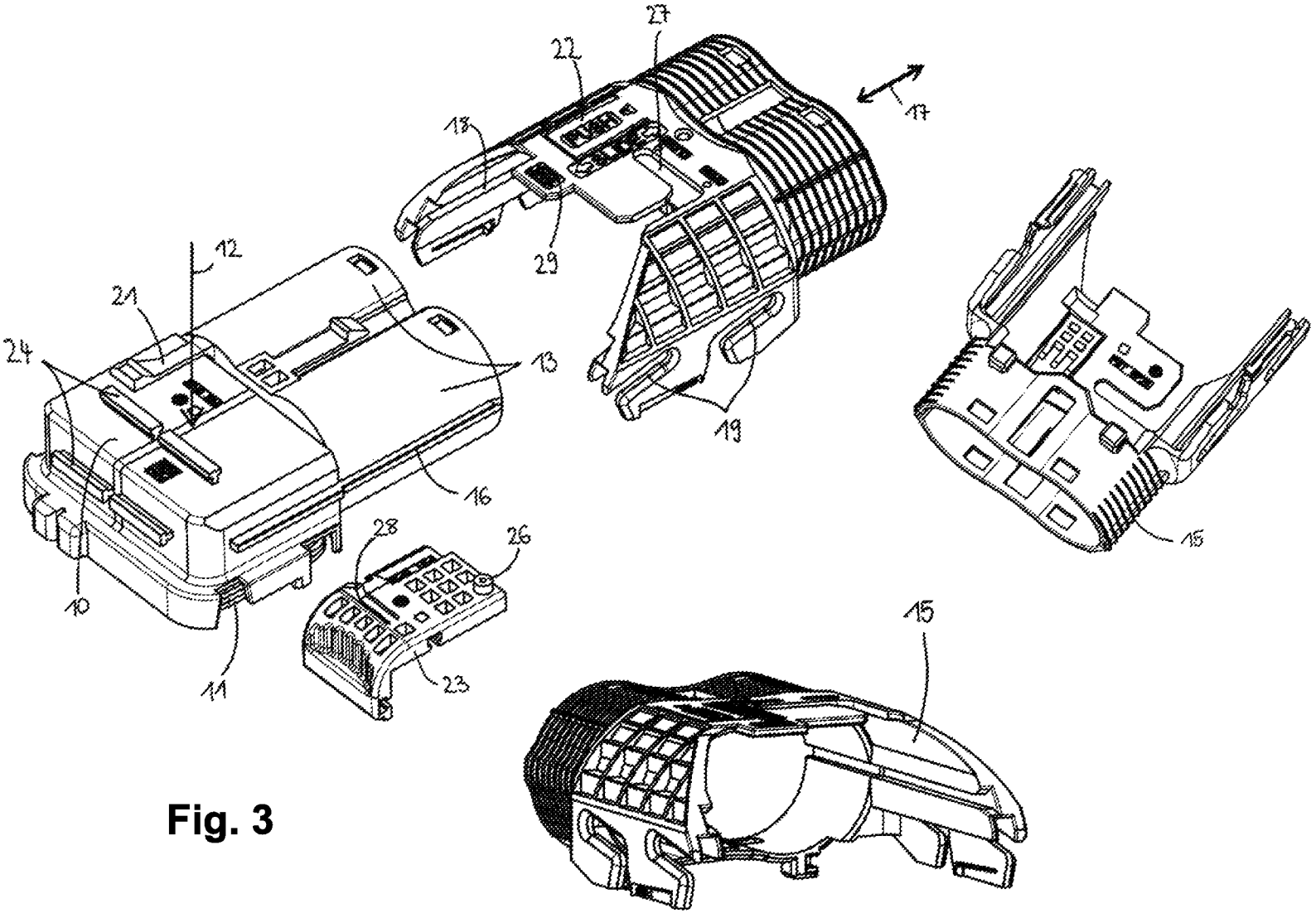
FIG. 3 shows an exploded view of a coupling connector.

FIG. 2 shows a perspective view of a coupling connector 9, and in FIG. 3, an exploded view of the coupling connector 9 is depicted. The coupling connector 9 comprises a base unit 10 with a second connecting part 11, wherein the second connecting part 11 is configured for being mated with the first connecting part 2 of the primary connector 1 in the mating direction 12. The base unit 10 further comprises two cable ports 13 adapted for accommodating power cables 14, the power cables 14 being electrically connected with respective sockets 33 (shown in FIG. 5*a*) of the second connecting part 11. The coupling connector 9 further comprises a slider part 15, the slider part 15 being movable relative to the base unit 10. The slider part 15 at least partially encloses the outer surface of the base unit 10. The slider part 15 is configured for sliding along the outer surface of the base unit 10 in a sliding direction. The slider part 15 is attached to the base unit 10 by means of a sliding mechanism. As shown in FIG. 3, the sliding mechanism comprises two ribs 16 that extend along the outer surface of the base unit 10 in the sliding direction 17. The sliding mechanism further comprises two grooves 18, with the grooves 18 extending along the inner surface of the slider part 15 in the sliding direction 17. The ribs 16 are configured for engaging with the grooves 18 to form a sliding mechanism that allows for moving the slider part 15 relative to the base unit 10. Preferably, the sliding direction 17 deviates by at most 30° from the cable direction. The cable direction is the direction of the power cables 14 at the point where the power cables 14 enter the coupling connector 9. Preferably, the sliding direction 17 of the slider part 15 is approximately equal to the cable direction. Relative to the axial direction of the cable ports 13, the sliding direction 17 of the slider part 15 is preferably oriented at an angle of at most 30°. Further preferably, the sliding direction 17 of the slider part 15 is approximately equal to the orientation of the cable ports 13. A portion of the slider part 15 that is oriented towards the at least one power cable 14 may for example surround the at least one cable port 13 and may slide along the at least one cable port 13. Preferably, the sliding direction 17 of the slider part 15 is oriented at an angle between 70° and 110° relative to the mating direction 12 of the second connecting part 11. Further preferably, the sliding direction 17 is approximately perpendicular to the mating direction 12 of the second connecting part 11.

The slider part 15 can be moved to a preliminary position and to a final position relative to the base unit 10. At least a part of the outer surface of the slider part 15 may for example be configured as a gripping surface. A user may grip the gripping surface in order to move the slider part 15 in the sliding direction 17. In FIG. 2, the slider part 15 is shown in its preliminary position. In this position, the coupling connector 9 is coupled with the primary connector 1. The second connecting part 11 is located at a position opposite to the first connecting part 2. Two inclined grooves 19 are disposed on each of the two lateral sides of the slider part 15 when viewed in the sliding direction 17. The pins 6 of the primary connector 1 engage with the inclined grooves 19 when the coupling connector 9 is coupled with the primary connector 1, with the slider part 15 being in its preliminary position. The inclined grooves 19 are configured for accepting the pins 6 of the primary connector 1. The inclined grooves 19 define the relative motion path of the slider part 15 relative to the primary connector 1 when the slider part 15 is moved from the preliminary position to the final position in the direction indicated by arrow 20. During the movement from the preliminary position to the final position, the relative motion path of the slider part 15 relative to the primary connector 1 is defined by the interaction between the pins 6 and the inclined grooves 19, which form respective guiding components of the slider part 15 and the primary connector 1, respectively. The inclined grooves 19 may for example be inclined by an angle of more than 10° relative to the sliding direction 17. Furthermore, the inclined grooves 19 may for example be inclined by an angle of less than 20° relative to the sliding direction 17.

The base unit 10 further comprises a latching element 21. As soon as the slider part 15 arrives at its final position, the latching element 21 latches a corresponding counter-latching element 45 (shown in FIG. 8), for example with a recess or a cutout of the slider part 15. The slider part 15 further comprises a release button 22. When the release button 22 is actuated, the latching element 21 disengages from the corresponding counter-latching element 45 and the slider part 15 can be moved back to its preliminary position.

The coupling connector 9 further comprises a locking member 23, also referred to as a connector position assurance or CPA. The locking member 23 can be moved along the guide rails 24 of the base unit 10 in a traverse direction 25. A pin 26 of the locking member 23 is engaged with an L-shaped groove or slot 27. In FIG. 2, the locking member 23 is shown in its non-locking position. As soon as the slider part 15 has arrived at its final position, the locking member 23 may be moved to the locking position. The locking member 23 further comprises a catch 28. When the locking member 23 is moved to the locking position, the catch 28 of the locking member 23 engages with a corresponding tongue 29 of the slider part 15. In the locking position of the locking member 23, the pin 26 is moved into the end portion of the L-shaped groove or slot 27, thereby locking the slider part 15 in its final position.

Preferably, the coupling connector has a length of more than 5 cm, further preferably of more than 8 cm, further preferably of more than 10 cm. Preferably, the coupling connector has a length of less than 25 cm, further preferably of less than 18 cm, further preferably of less than 14 cm. Preferably, the coupling connector has a width of more than 4 cm, further preferably of more than 6 cm, further preferably of more than 8 cm. Preferably, the coupling connector has a width of less than 15 cm, further preferably of less than 12 cm, further preferably of less than 10 cm. Preferably, the coupling connector has a height of more than 2 cm, further preferably of more than 4 cm. Preferably, the coupling connector has a height of less than 12 cm, further preferably of less than 8 cm, further preferably of less than 6 cm.

Preferably, the primary connector 1, the base unit 10, the slider part 15 and the locking member 23 are made of plastic material. Preferably, these components are formed by injection molding.

Figure 4A:
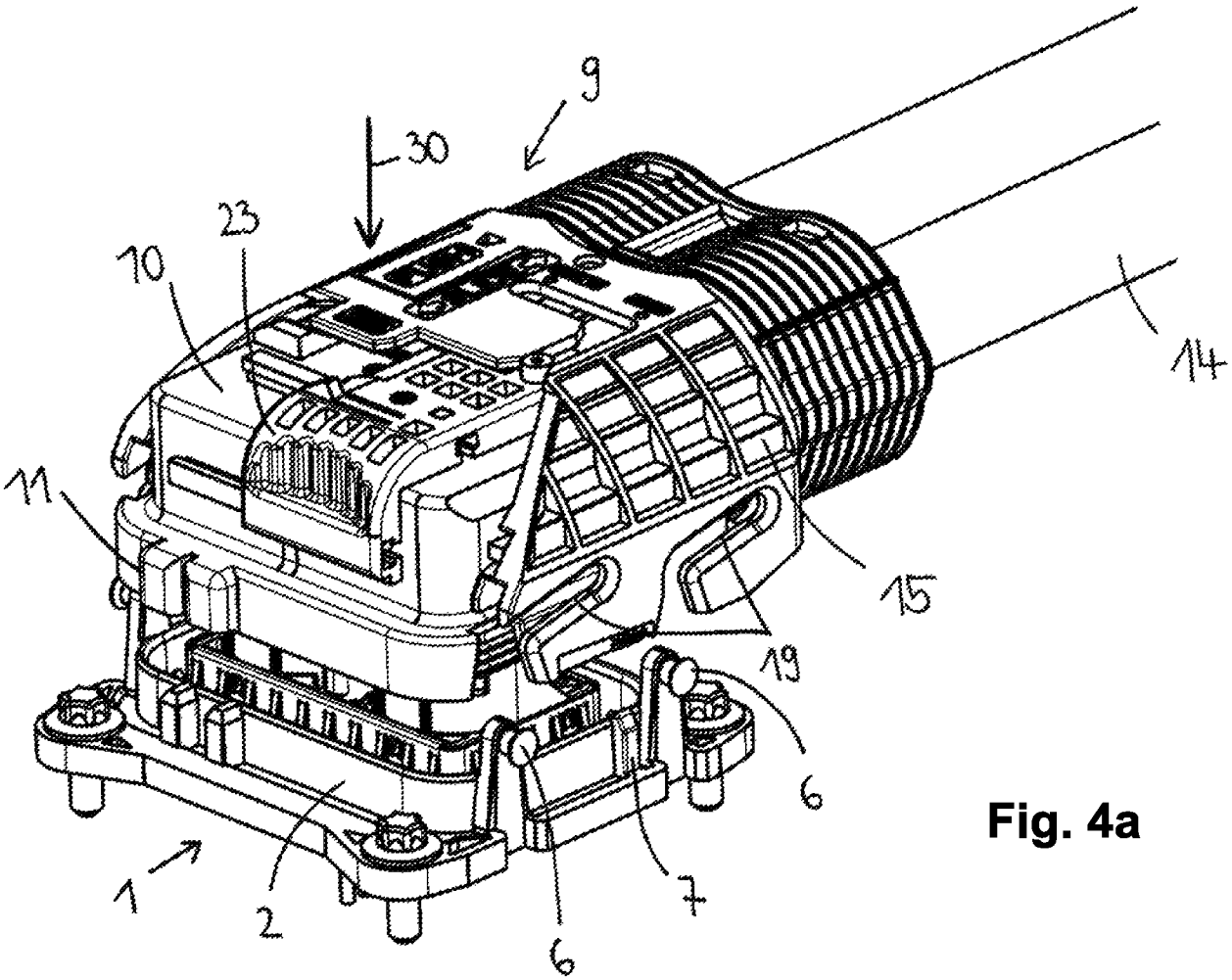
FIGS. 4*a* to 4*d* show the steps in the process of connecting the coupling connector and the primary connector.

In FIGS. 4*a* to 4*d*, the process of connecting the coupling connector 9 and the primary connector 1 is illustrated. As shown in FIG. 4*a*, the coupling connector 9 is coupled with the primary connector 1, with the slider part 15 being in its preliminary position. The first connecting part 2 of the primary connector 1 is aligned with the second connecting part 11 of the coupling connector 9 and the coupling connector 9 is moved towards the primary connector 1 as indicated by arrow 30. The pins 6 of the primary connector 1 engage with the two inclined grooves 19 disposed at each lateral side of the slider part 15 when viewed in the sliding direction 17.

Figure 4B:
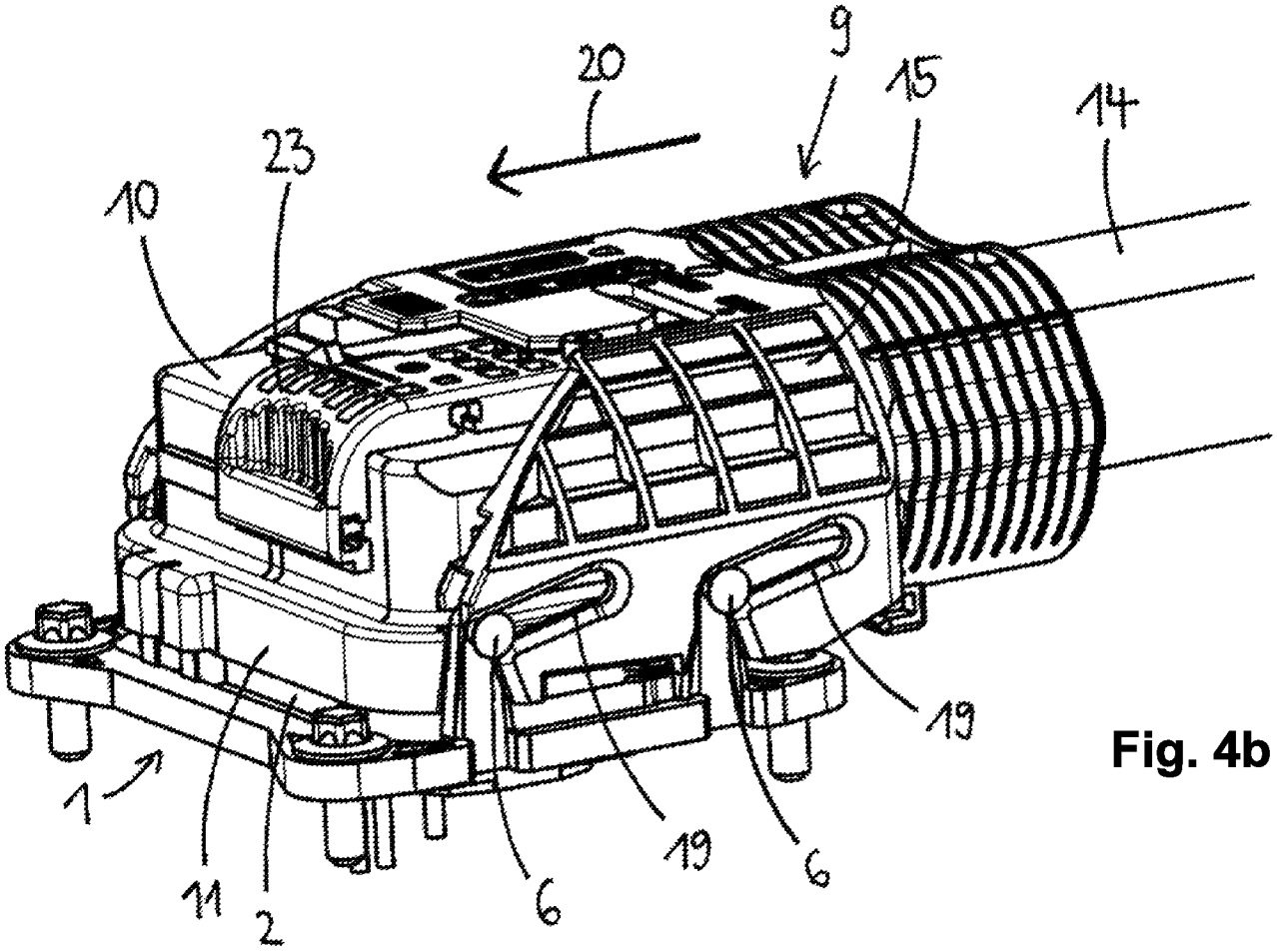

Next, as shown in FIG. 4*b*, the slider part 15 is moved in the direction indicated by arrow 20. Accordingly, the slider part 15 slides along the ribs 16 of the base unit 10 in the sliding direction 17. The motion path of the slider part 15 relative to the primary connector 1 is defined by the inclined grooves 19. The inclined grooves 19 extend at an angle of more than 10° and less than 20° relative to the sliding direction 17. For this reason, when the slider part 15 moves in the direction of arrow 20, the slider part 15 continually gets closer to the primary connector 1 and presses the base unit 10 and the second connecting part 11 towards the first connecting part 2.

Figure 4C:
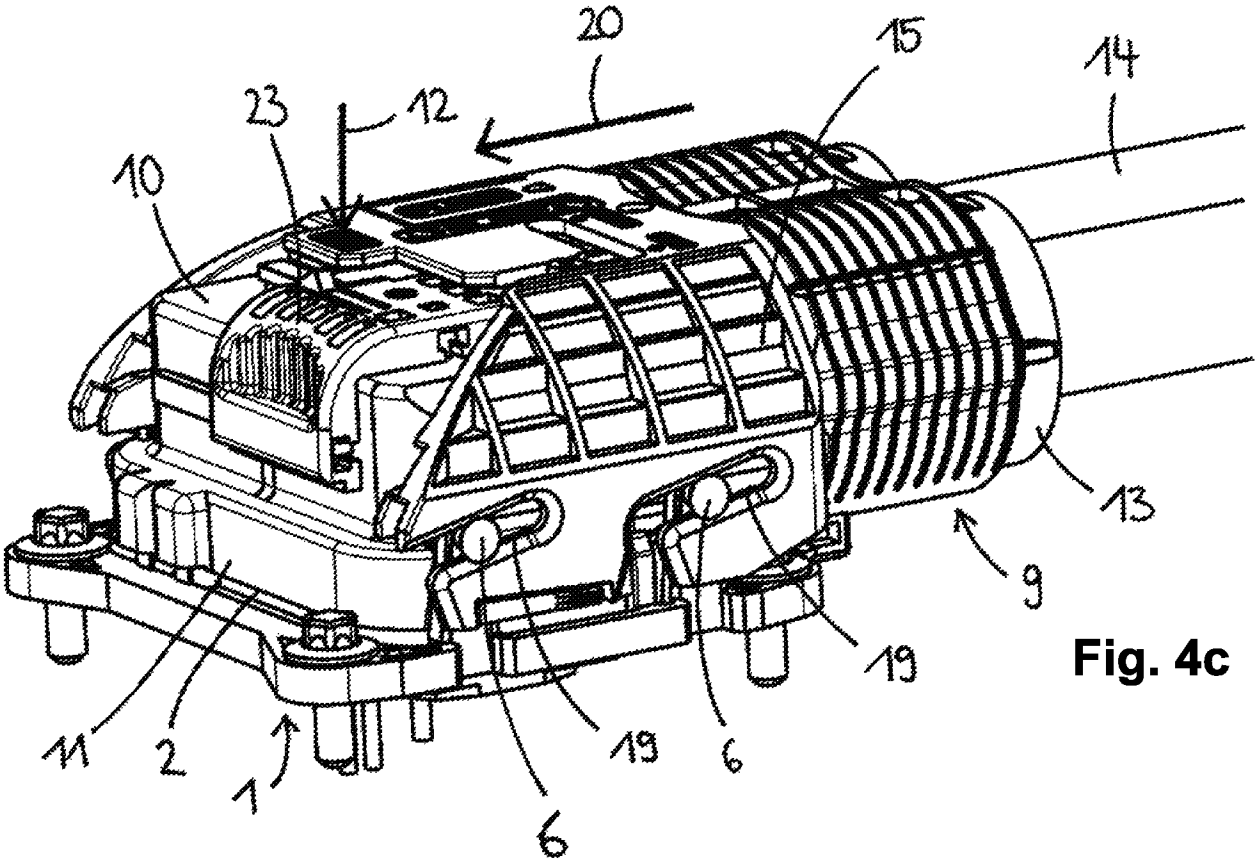

As shown in FIG. 4*c*, the first connecting part 2 is mated with the second connecting part 11. The contact pins 3 of the first connecting part 2 are inserted into the sockets 33 (shown in FIG. 5*a*) of the second connecting part 11, with electrical contacts being established between the contact pins 3 and the sockets 33. Because of the inclined orientation of the inclined grooves 19, the sliding movement of the slider part 15 is converted into an insertion force acting in the mating direction 12. Thus, an insertion force of sufficient magnitude, for example of more than 75 N, can be generated.

Figure 4D:
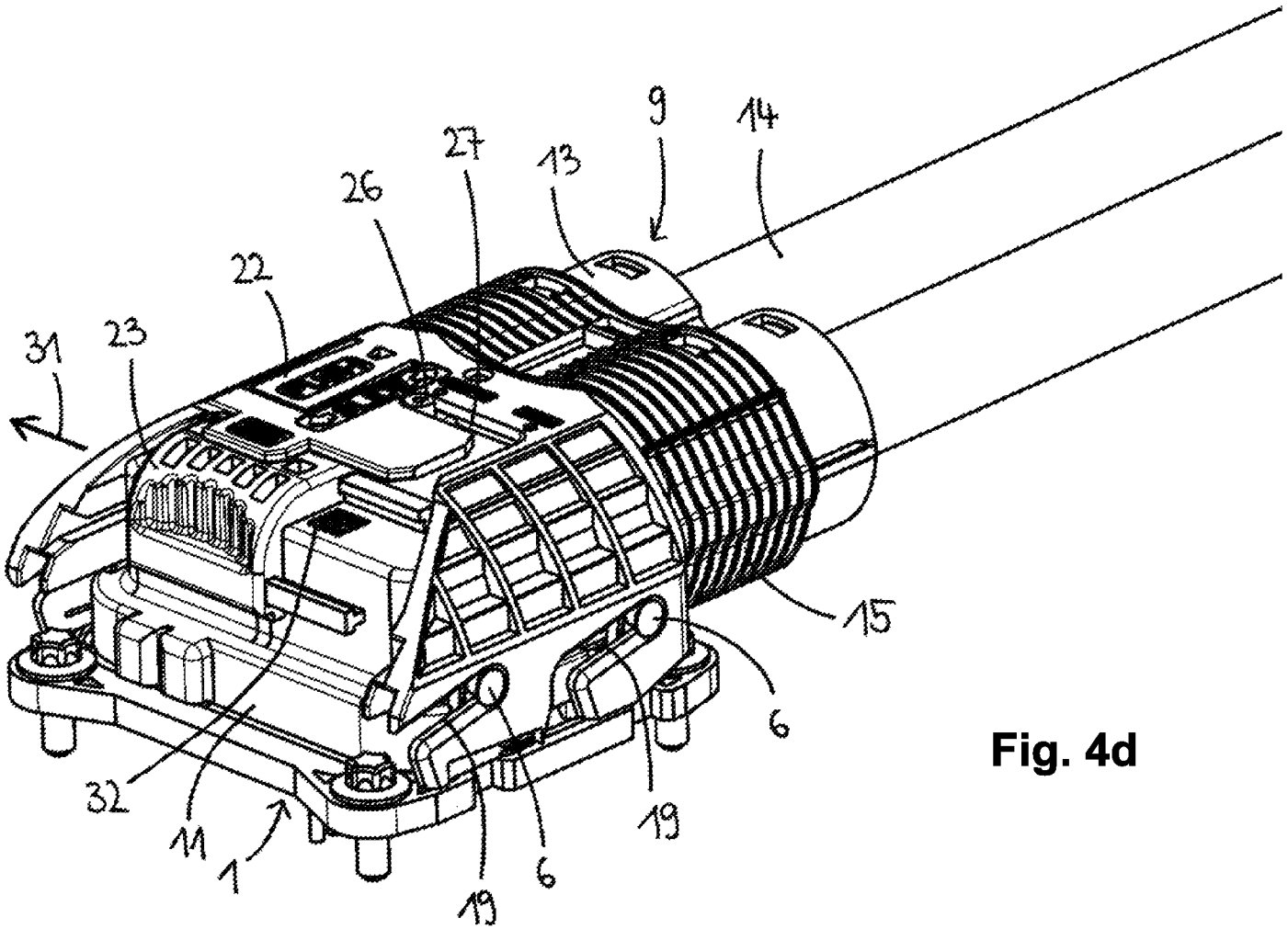

In FIG. 4*d*, the slider part 15 has arrived at its final position and the pins 6 have reached the end of the inclined grooves 19. In the final position, the latching element 21 of the base unit 10 latches the counter-latching element 45 (shown in FIG. 8) of the slider part 15. In order to lock the coupling connector 9 in its final position, the locking member 23 is moved from the non-locking position to the locking position in the direction indicated by arrow 31. The pin 26 of the locking member 23 enters the end portion of the L-shaped groove 27 and accordingly, the slider part 15 is positively locked. Furthermore, when the locking member 23 is moved to its locking position, a QR code 32 on top of the base unit 10 is exposed. This QR code 32 can be captured and identified with an image processing system, in order to verify that the coupling connector 9 has been properly connected with the primary connector 1.

In the coupling connector 9, the sliding direction 17 of the slider part 15 corresponds to the axial direction of the cable ports 13 and to the direction of the power cables 14 entering the coupling connector 9. For example, the sliding direction 17 of the slider part 15 does not deviate more than 30° from the axial direction of the cable ports 13. Accordingly, when moving the slider part 15 from the preliminary position to the final position, the slider part 15 is moved in the direction of the power cables 14, which minimizes installation space.

In the connector system, the primary connector 1 preferably comprises at least two pins 6 on each lateral side and the slider part 15 comprises at least two corresponding inclined grooves 19 configured for accommodating the pins 6. Accordingly, at least two guiding components are provided on each lateral side of the slider part 15 and at least two corresponding guiding components are provided on the primary connector 1. The guiding components stabilize the orientation of the coupling connector 9 and support the coupling connector 9 when the coupling connector 9 is mated with the primary connector 1. The at least two guiding components per lateral side of the connector system provide a stable seating for the coupling connector 9. In particular, by providing two or more guiding components per lateral side, tilting of the coupling connector 9 relative to the primary connector 1 is prevented during the process of mating the two connectors.

Figure 5A:
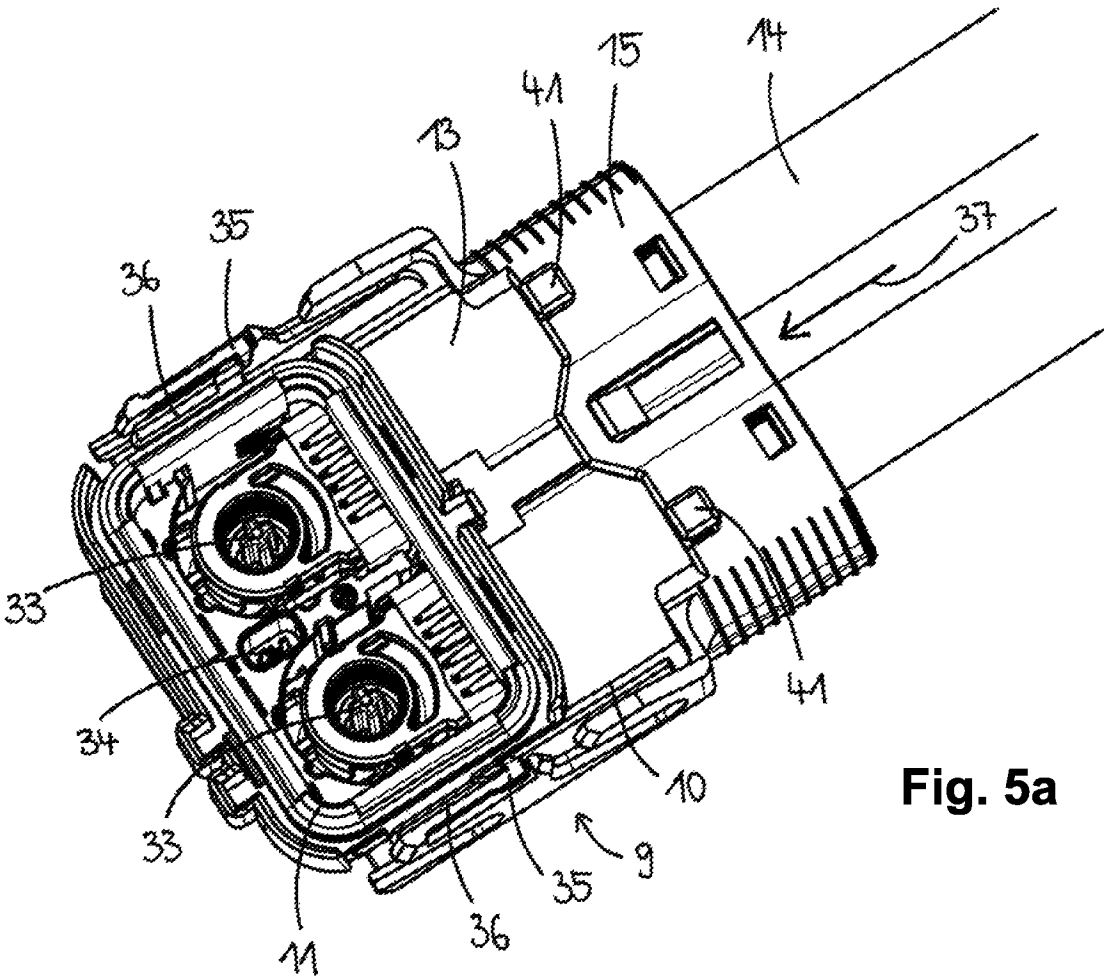
FIG. 5*a* illustrates a further locking mechanism for locking the slider part in its preliminary position.
Figure 5B:
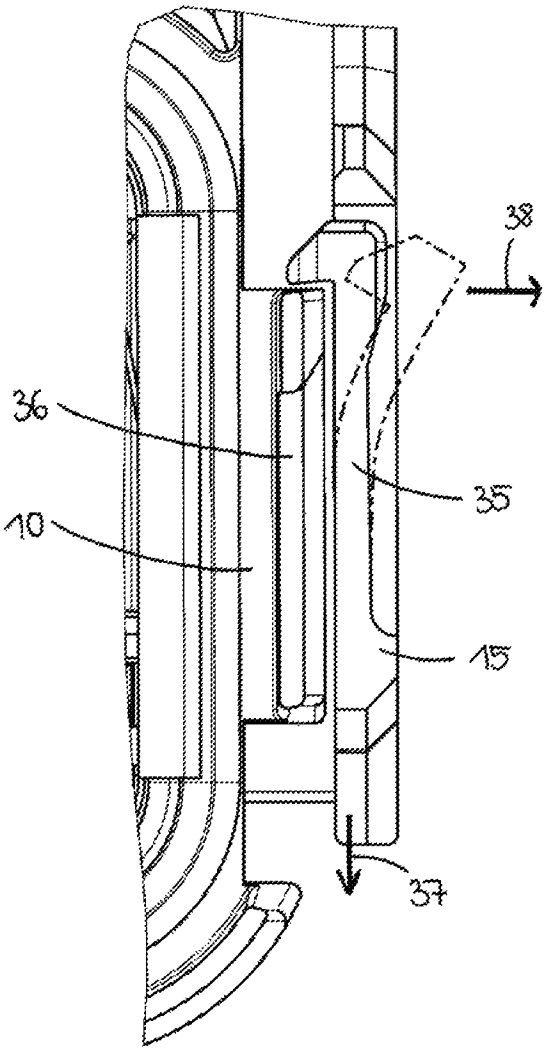
FIG. 5*b* shows a detail of FIG. 5*a*.

FIGS. 5*a* and 5*b* show a further locking mechanism configured for locking the slider part 15 in its preliminary position relative to the base unit 10 as long as the coupling connector 9 is not coupled with the primary connector 1. FIG. 5*a* shows a bottom view of the coupling connector 9 with the connector face of the second connecting part 11. The second connecting part 11 comprises two sockets 33. Furthermore, the second connecting part 11 comprises a contact bridge 34 with two contact pins that are electrically connected. For example, the contact bridge 34 may comprise a U-shaped contact pin. The contact bridge 34 is configured for shortcutting the two signal contact elements 4 shown in FIG. 1 when the primary connector 1 and the coupling connector 9 are mated. A control circuit or control software may be configured for monitoring whether or not the two signal contact elements 4 are shortcut. As long as no shortcut is detected, the current cannot be switched on. Only in case a shortcut is detected, the current can be switched on. Thus, it is made sure that the primary connector 1 and the coupling connector 9 are mated before the current is switched on. In case the connection between the primary connector 1 and the coupling connector 9 is interrupted, the current will be switched off immediately.

The locking mechanism comprises first locking elements 35 resiliently mounted to the lateral sides of the slider part 15 and second locking elements 36 attached to the base unit 10. Because of the interaction between the first locking elements 35 and the second locking elements 36, the slider part 15 is locked in its preliminary position relative to the base unit 10. Thus, when the coupling connector 9 is placed on the primary connector 1, the slider part 15 will be in its preliminary position.

In FIG. 5*b*, a more detailed view of the locking mechanism is given. FIG. 5*b* shows the first locking element 35, which is resiliently mounted on the slider part 15, and the second locking element 36, which is attached to the base unit 10. It can be seen from FIG. 5*b* that the second locking element 36 is locked by the first locking element 35. As a consequence, the slider part 15 is locked in its preliminary position. Hence, as long as the coupling connector 9 is not placed on the primary connector 1, the slider part 15 is locked and cannot move in the direction indicated by arrow 37.

As shown in FIGS. 1, 4*a* and 4*c*, the primary connector 1 comprises chamfered pin elements 7 located at the lateral sides of the primary connector 1. The chamfered pin elements 7 are configured for interacting with the first locking elements 35 when the coupling connector 9 is mated with the primary connector 1. The chamfered pin elements 7 are inserted in the space behind the first locking elements 35 and push the first locking elements 35 in an outward direction, as indicated by arrow 38 in FIG. 5*b*. Accordingly, the first locking element 35 shown in FIG. 5*b* is resiliently deformed, with the outline of the deformed first locking element 35 being indicated with broken lines. Now, the second locking element 36 is no longer locked by the first locking element 35, and the slider part 15 can move in the direction indicated by arrow 37. Hence, as soon as the coupling connector 9 is placed on the primary connector 1, the slider part 15 is no longer locked in the preliminary position and can move to the final position as shown in FIGS. 4*a* to 4*d*.

Figure 6A:
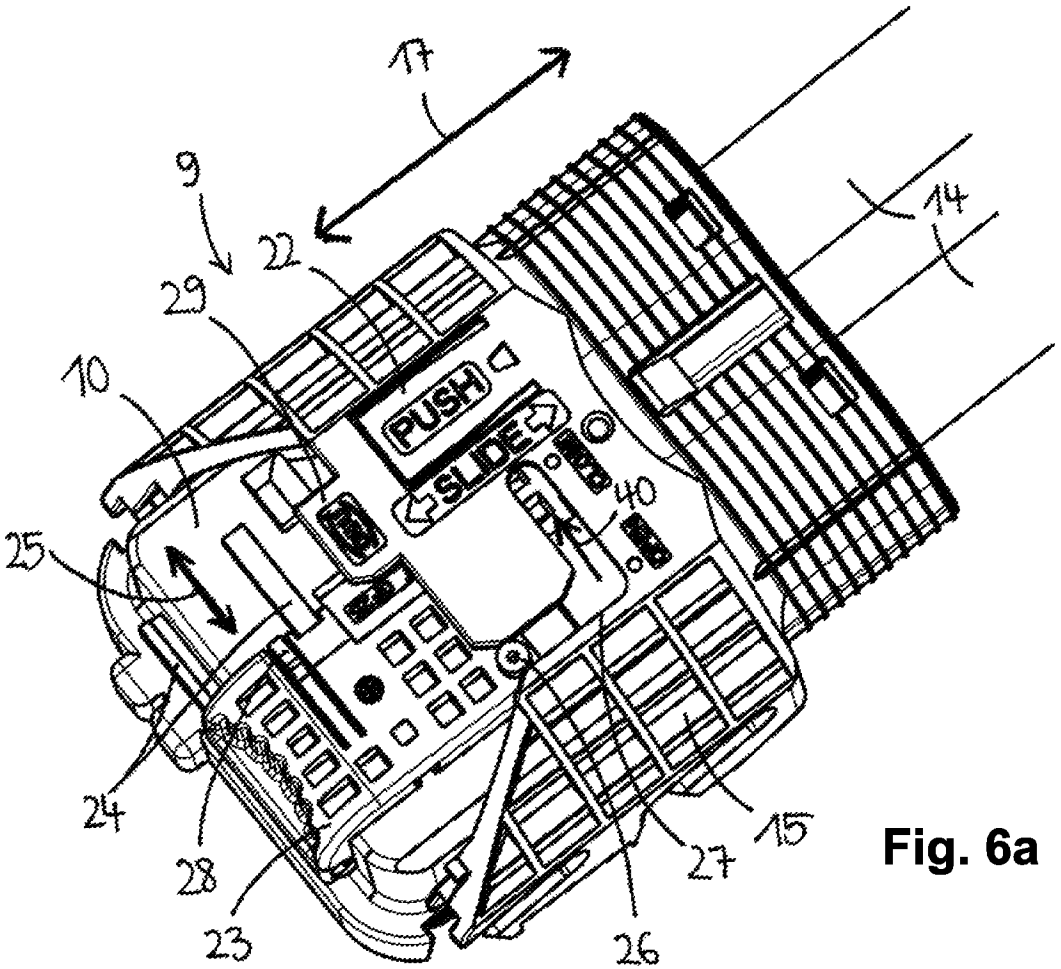
FIG. 6*a* shows the locking member in its non-locking position.
Figure 6B:
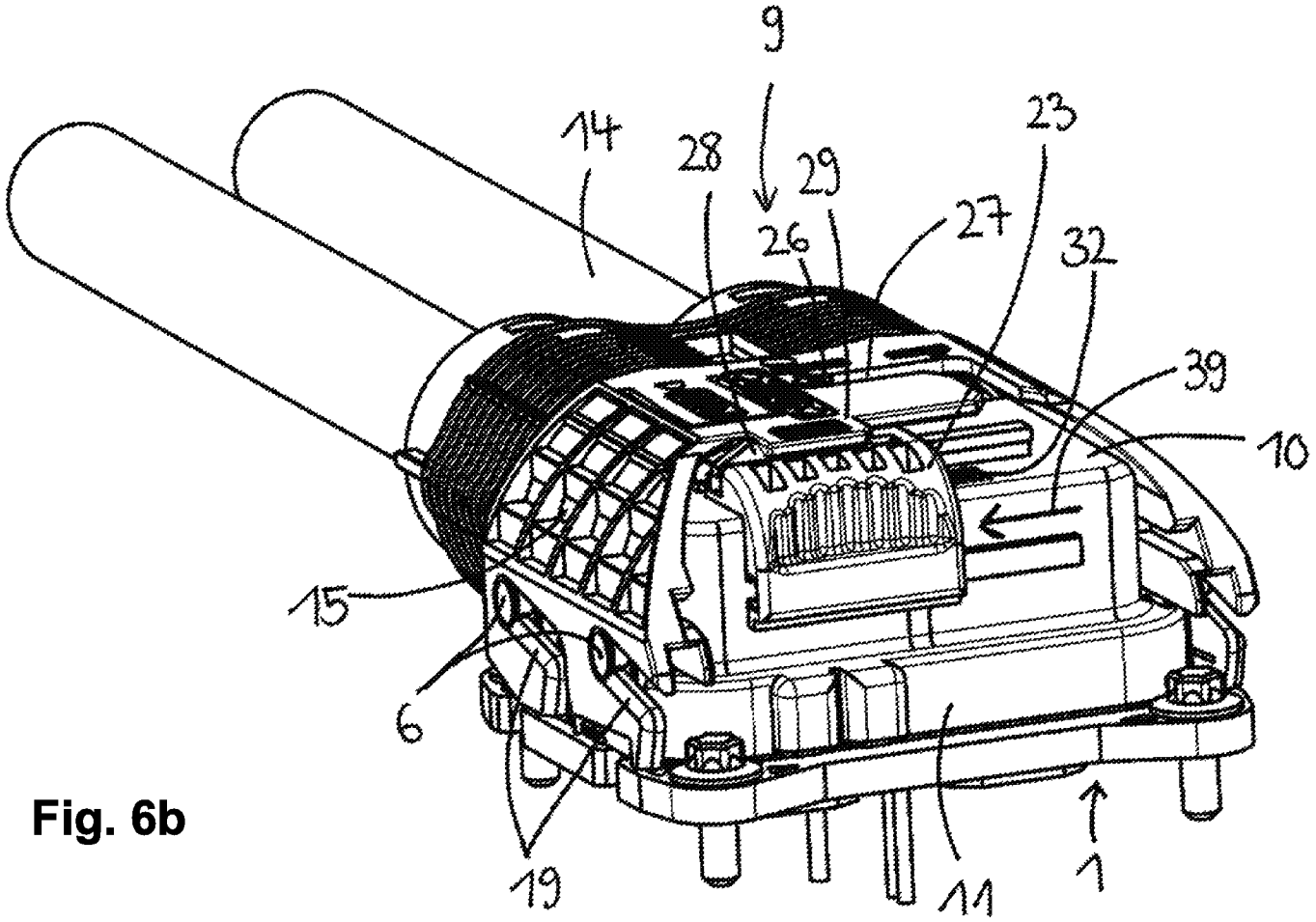
FIG. 6*b* shows the locking member in its locking position.

In FIGS. 6*a* and 6*b*, the operation of the locking member 23 is illustrated. The locking member 23 is configured for moving along the guide rails 24 in a traverse direction 25. The pin 26 of the locking member 23 is engaged with the L-shaped groove or slot 27. In FIG. 6*a*, the locking member 23 is shown in its non-locking position. When the locking member 23 is in its non-locking position, the slider part 15 can be moved from the preliminary position to the final position. When the slider part 15 arrives at its final position, the latching element 21 of the base unit 10 latches the counter-latching element 45 (shown in FIG. 8) of the slider part 15. The slider part 15 can be locked in its final position by moving the locking member 23 from the non-locking position to the locking position. In FIG. 6*b*, the locking member 23 is shown in the locking position, with arrow 39 indicating the movement from the non-locking position to the locking position. When the locking member 23 is moved to the locking position, the pin 26 of the locking member 23 moves into the end portion of the L-shaped groove or slot 27, as indicated by arrow 40, and the slider part 15 is positively locked. Furthermore, the catch 28 of the locking member 23 engages with the tongue 29 of the slider part 15. In FIG. 6*b*, it can be seen that the approach slope of the catch 28 for moving in the direction from the non-locking position to the locking position is about 30°. In contrast, the approach slope of the catch 28 for moving in the opposite direction from the locking position to the non-locking position is about 60°. Hence, the force required for locking the slider part 15 is considerably smaller than the force required for unlocking the slider part 15. Thus, the connection cannot be unlocked inadvertently. This is an important feature especially for power connectors.

Preferably, the approach slope of the catch 28 for moving in the direction from the non-locking position to the locking position is more than 20°. Further preferably, this approach slope is less than 40°. Preferably, the approach slope of the catch 28 for moving in the direction from the locking position to the non-locking position is more than 45°, further preferably, this approach slope is less than 75°.

In addition, in the locking member's locking position shown in FIG. 6*b*, a part of the locking member 23 reaches under the latching element 21 in a way that the latching element 21 is blocked. In particular, in the locking member's locking position, a part of the locking member 23 is inserted into an interspace between the latching element 21 and the remaining part of the base unit 10 such that the latching element 21 is blocked. When the user tries to press the release button 22 in the locking member's locking position, the latching element 21 abuts against said part of the locking member 23 and accordingly, the latching element 21 is blocked. Thus, it is no longer possible to disengage the latching element 21 and the corresponding counter-latching element 45 (shown in FIG. 8) by actuating the release button 22. In the locking member's locking position, the engagement between the latching element 21 and the corresponding counter-latching element 45 cannot be released. Blocking the latching element 21 is a further mechanism for locking the slider part 15 in its final position.

Figure 7:
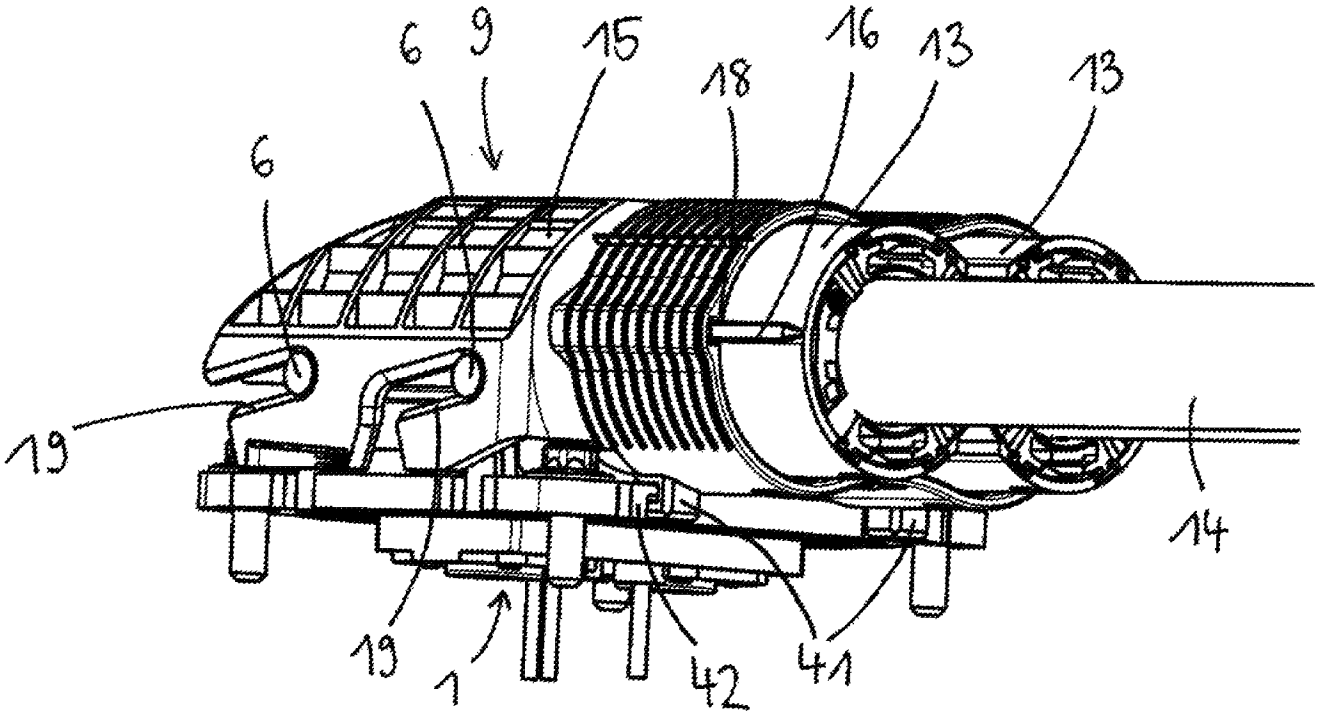
FIG. 7 shows a plurality of supporting elements configured for stabilizing the coupling connector.

FIG. 7 shows a perspective view of the connector system from the side where the cable ports 13 are located. Furthermore, the rib 16 and the groove 18 of the sliding mechanism are shown. When viewed along the sliding direction 17, two supporting elements 41 are located in the rear part of the coupling connector 9, i.e. in the part where the cable ports 13 are located. The supporting elements 41 are disposed on the side of the slider part 15 that faces the primary connector 1. When the slider part 15 is moved from its preliminary position to its final position, the supporting elements 41 are moved in the direction towards the counter pieces 42 located at the rear part of the primary connector 1 when viewed in the sliding direction 17. When the slider part 15 reaches its final position, the supporting elements 41 engage with the counter pieces 42. For example, the supporting elements 41 may have a shape that is complementary to the shape of the counter pieces 42. For example, each of the supporting elements 41 may have an undercut configured for engaging with a corresponding counter piece 42. When the supporting elements 41 are engaged with the counter pieces 42, they provide an additional support for the coupling connector 9 at several additional points of support. In particular, due to the presence of the supporting elements 41, the coupling connector 9 is stabilized and tilting of the coupling connector 9 relative to the primary connector 1 is prevented.

Figure 8:
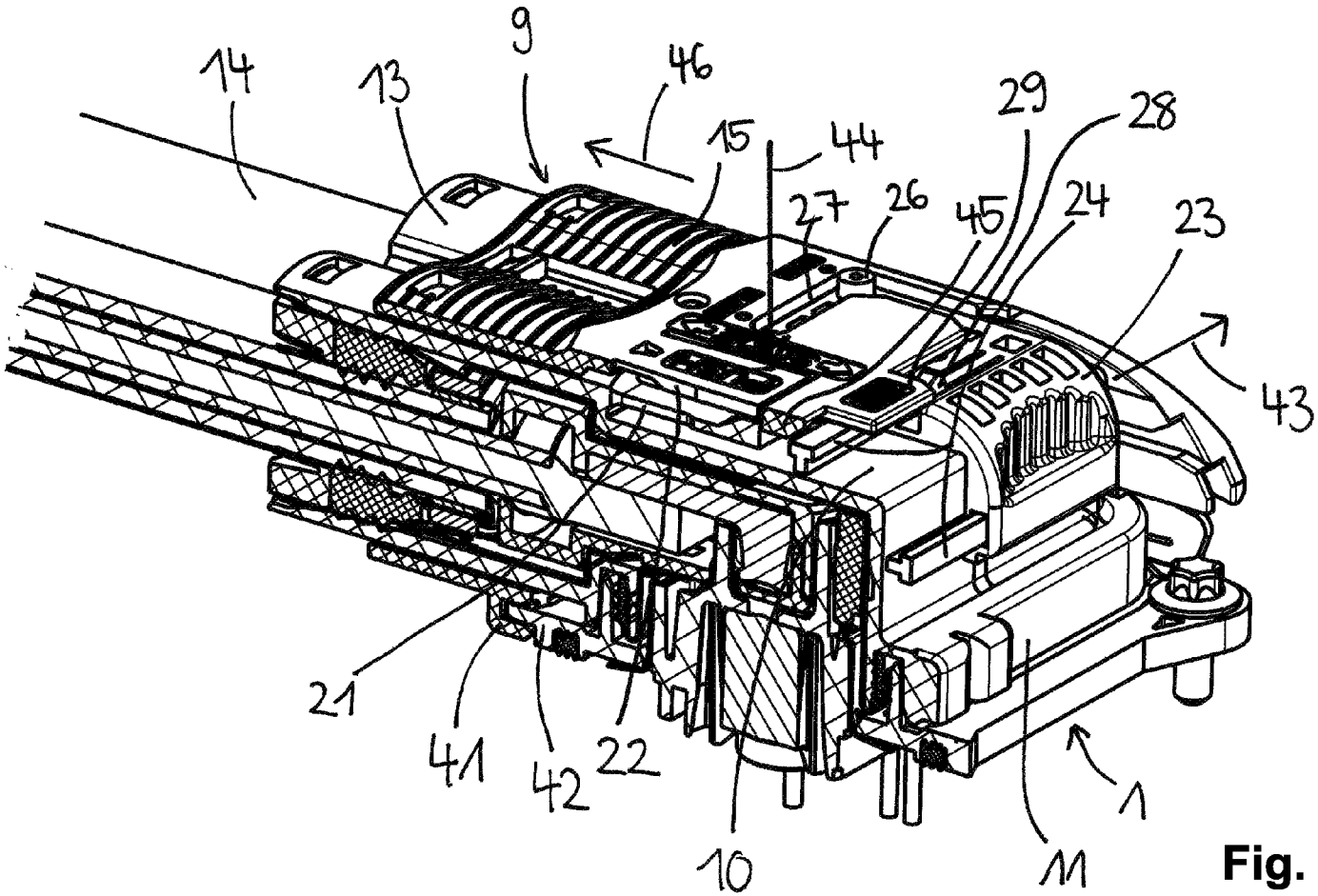
FIG. 8 illustrates how the coupling connector is disconnected from the primary connector.

FIG. 8 shows the process of disconnecting the coupling connector 9 from the primary connector 1. In a first step, the locking member 23 is moved in the direction of arrow 43 from the locking position to the non-locking position. The pin 26 is moved to the corner of the L-shaped groove or slot 27 and accordingly, the slider part 15 is no longer locked by the pin 26. Furthermore, by moving the locking member 23 to the non-locking position, the latching element 21 is not blocked any more. In the next step, the release button 22 is pressed in a downward direction as indicated by arrow 44. The release button 22 is pressed against the latching element 21 of the base unit 10 and disengages the latching element 21 from the counter-latching element 45 of the slider part 15. Now, the slider part 15 can be moved in the direction of arrow 46 from the final position to the preliminary position. The supporting element 41 is removed from its counter piece 42. Then, the coupling connector 9 can be disconnected from the primary connector 1.

The features as described in the above description, claims and figures can be relevant individually or in any combination to realise the various embodiments of the invention.

LIST OF REFERENCE NUMERALS

The following is a list of referenced numerals used in this application:

1 primary connector
2 first connecting part
3 contact pins
4 signal contact elements
5 mating direction
6 pin
7 chamfered pin element
8 screws
9 coupling connector
10 base unit
11 second connecting part
12 mating direction
13 cable ports
14 power cables
15 slider part
16 ribs
17 sliding direction
18 grooves
19 inclined grooves
20 arrow
21 latching element
22 release button
23 locking member
24 guide rails
25 traverse direction
26 pin
27 L-shaped groove or slot
28 catch
29 tongue
30 arrow
31 arrow
32 QR code
33 sockets
34 contact bridge
35 first locking element
36 second locking element
37 arrow
38 arrow
39 arrow
40 arrow
41 supporting elements
42 counter pieces
43 arrow
44 arrow
45 counter-latching element
46 arrow

The invention claimed is:

1. A connector system comprising a primary connector comprising a first connecting part, a coupling connector comprising a base unit with a second connecting part, the coupling connector further comprising a slider part configured for moving relative to the base unit in a sliding direction, wherein the slider part can be moved to a preliminary position and to a final position relative to the base unit, wherein the second connecting part of the coupling connector is configured to mate with the first connecting part of the primary connector in a mating direction, wherein the slider part comprises at least one first guiding component and the primary connector further comprises at least one second guiding component, wherein the at least one first guiding component and the at least one second guiding component are configured for interacting to enforce a predefined motion path of the slider part relative to the primary connector when the coupling connector is coupled with the primary connector and the slider part is moved from the preliminary position to the final position, wherein the slider part's motion along the predefined motion path comprises pressing the second connecting part against the first connecting part such that the first connecting part and the second connecting part are mated in the mating direction and wherein the slider part is a sleeve that at least partially encloses the base unit.

2. The connector system of claim 1, wherein the slider part comprises at least two first guiding components per lateral side on each of the two lateral sides of the slider part, wherein the at least two first guiding components per lateral side are spaced from one another in the sliding direction, wherein the primary connector further comprises second guiding components that correspond to the first guiding components, wherein the at least two first guiding components per lateral side of the slider part are configured for engaging with the corresponding second guiding components of the primary connector.

3. The connector system of claim 1, wherein the coupling connector comprises at least one cable port configured for introducing at least one cable to the coupling connector.

4. The connector system of claim 3, wherein the sliding direction of the slider part is oriented at an angle of at most 30° relative to a cable direction of the at least one cable entering the coupling connector.

5. The connector system of claim 1, wherein the base unit comprises at least one latching element, wherein the slider part further comprises at least one counter-latching element, wherein the at least one latching element is configured for latching with the at least one counter-latching element when the slider part reaches its final position relative to the base unit.

6. The connector system of claim 5, wherein the slider part or the base unit comprises a release button configured for releasing, upon actuation, an engagement between the at least one latching element and the at least one counter-latching element.

7. The connector system of claim 1, wherein the coupling connector comprises a locking member, wherein the locking member is configured for being moved either to a non-locking position or to a locking position when the slider part is in its final position, and wherein the slider part is locked when the locking member is in the locking position.

8. The connector system of claim 7, wherein the base unit further comprises at least one latching element and wherein the locking member is configured for blocking at least one of the base unit's latching elements in the locking member's locking position.

9. The connector system of claim 7, wherein a part of the locking member is configured for reaching under at least one of the base unit's latching elements in the locking member's locking position such that at least one of the latching elements is blocked.

10. The connector system of claim 7, wherein the coupling connector comprises a data code, the data code being disposed such that when the locking member is in its locking position, the data code is exposed, and when the locking member is in its non-locking position, the data code is not exposed.

11. The connector system of claim 1, wherein the connector system comprises a further locking mechanism configured for hindering the slider part from moving from the preliminary position to the final position as long as the coupling connector is not coupled with the primary connector.

12. The connector system of claim 1, wherein at least one supporting element is provided at a portion of the slider part that faces the primary connector, wherein the at least one supporting element is configured to engage with at least one corresponding counter piece of the primary connector when the slider part is moved to its final position.

13. The connector system of claim 1, wherein the connector system is configured for establishing an electrical connection between a traction battery and an electric component of a vehicle.

14. A method for connecting a coupling connector and a primary connector, the primary connector comprising a first connecting part, the coupling connector comprising a base unit with a second connecting part and further comprising a slider part configured for moving relative to the base unit in a sliding direction, wherein the slider part can be moved to a preliminary position and to a final position relative to the base unit, wherein the slider part is implemented as a sleeve that at least partially encloses the base unit, and wherein the slider part comprises at least one first guiding component and the primary connector comprises at least one second guiding component, the method comprising:

coupling the coupling connector with the primary connector; and moving the slider part from the preliminary position to the final position, wherein the at least one first guiding component and the at least one second guiding component interact to enforce a predefined motion path of the slider part relative to the primary connector, wherein the slider part's motion along the predefined motion path comprises pressing the second connecting part against the first connecting part such that the first connecting part and the second connecting part are mated in the mating direction.

15. A connector system comprising:

a primary connector comprising a first connecting part, and a coupling connector comprising a base unit with a second connecting part, the coupling connector further comprising a slider part configured for moving relative to the base unit in a sliding direction, wherein the slider part can be moved to a preliminary position and to a final position relative to the base unit, wherein the second connecting part of the coupling connector is configured to mate with the first connecting part of the primary connector in a mating direction when the slider part is moved from the preliminary position to the final position, wherein the coupling connector further comprises a latching mechanism, wherein when the slider part reaches the final position, at least one latching element of the base unit engages with at least one counter-latching element of the slider part, and the slider part or the base unit comprises a release button configured for releasing, upon actuation, the engagement between the at least one latching element and the at least one counter-latching element.

16. A connector system comprising:

a primary connector comprising a first connecting part, and a coupling connector comprising a base unit with a second connecting part, the coupling connector further comprising a slider part configured for moving relative to the base unit in a sliding direction, wherein the slider part can be moved to a preliminary position and to a final position relative to the base unit, wherein the second connecting part of the coupling connector is configured to mate with the first connecting part of the primary connector in a mating direction when the slider part is moved from the preliminary position to the final position, wherein the coupling connector comprises a locking member, wherein the locking member is configured for being moved either to a non-locking position or to a locking position in case the slider part is in its final position, wherein in the locking member's locking position, the slider part is locked by means of the locking member blocking at least one of the base unit's latching elements or blocking a release button, the release button being configured for releasing, upon actuation, the engagement between the at least one latching element and the at least one counter-latching element.

17. A connector system comprising:

a primary connector comprising a first connecting part, a coupling connector comprising a base unit with a second connecting part, the coupling connector further comprising a slider part configured for moving relative to the base unit in a sliding direction, wherein the slider part can be moved to a preliminary position and to a final position relative to the base unit, wherein the second connecting part of the coupling connector is configured to mate with the first connecting part of the primary connector in a mating direction when the slider part is moved from the preliminary position to the final position, and a locking mechanism configured for hindering the slider part from moving from the preliminary position to the final position as long as the coupling connector is not coupled with the primary connector, wherein the coupling connector and the primary connector are shaped and configured such that the locking mechanism is unlocked when the coupling connector and the primary connector are coupled.

18. A connector system comprising:

a primary connector comprising a first connecting part, a coupling connector comprising a base unit with a second connecting part, the coupling connector further comprising a slider part configured for moving relative to the base unit in a sliding direction, wherein the slider part can be moved to a preliminary position and to a final position relative to the base unit, wherein the second connecting part of the coupling connector is configured to mate with the first connecting part of the primary connector in a mating direction when the slider part is moved from the preliminary position to the final position;

wherein the slider part comprises at least one first guiding component and the primary connector further comprises at least one second guiding component, wherein the at least one first guiding component and the at least one second guiding component are configured for interacting to enforce a predefined motion path of the slider part relative to the primary connector when the coupling connector is coupled with the primary connector and the slider part is moved from the preliminary position to the final position; and wherein at least one supporting element is positioned at a portion of the slider part that faces the primary connector, wherein the at least one supporting element is configured for engaging with at least one corresponding counter piece of the primary connector when the slider part is moved to its final position thereby providing at least one additional point of support for stabilising the coupling connector relative to the primary connector.

* * * * *